US006293599B1

(12) United States Patent
Garcia

(10) Patent No.: US 6,293,599 B1
(45) Date of Patent: Sep. 25, 2001

(54) DISPOSABLE LOCK AND SEAL DEVICE

(76) Inventor: Juan Ricardo Garcia, 9551 SW. 49th St., Miami, FL (US) 33165

( * ) Notice: Subject to any disclaimer, the term of this patent is extended or adjusted under 35 U.S.C. 154(b) by 0 days.

(21) Appl. No.: 09/267,575

(22) Filed: Mar. 12, 1999

(51) Int. Cl.[7] ..... B65D 27/30
(52) U.S. Cl. ..... 292/317; 292/307 R; 292/319
(58) Field of Search ..... 292/317, 246, 292/307 R, 318, 319, 320; 70/18, 30, 49, 14; 24/687, 265 R, 115 F, 16 PB; 403/78, 164, 165, 371, 313; 411/525, 526, 528

(56) References Cited

U.S. PATENT DOCUMENTS

| | | | | |
|---|---|---|---|---|
| 2,554,520 | * | 5/1951 | Canter | 292/317 |
| 2,851,294 | * | 9/1958 | Mount | 403/78 |
| 3,435,642 | * | 4/1969 | Del Pesco | 70/49 |
| 3,862,775 | * | 1/1975 | Gudmundsen | 292/327 |
| 3,975,040 | * | 8/1976 | Van Gompel | 292/318 |
| 3,980,337 | * | 9/1976 | Moberg et al. | 292/319 |
| 4,075,742 | * | 2/1978 | Remark et al. | 24/211 R |
| 4,402,639 | * | 9/1983 | Kessler | 411/51 |
| 4,592,579 | * | 6/1986 | Burnett | 292/327 |
| 4,929,006 | * | 5/1990 | Tsay | 292/324 |
| 4,986,457 | * | 1/1991 | Faris | 223/1 |
| 5,056,837 | * | 10/1991 | Fuehrer | 292/307 R |
| 5,582,447 | * | 12/1996 | Leon et al. | 292/307 R |
| 5,709,110 | * | 1/1998 | Greenfield et al. | 70/58 |

* cited by examiner

*Primary Examiner*—B. Dayoan
*Assistant Examiner*—Clifford B Vaterlaus
(74) *Attorney, Agent, or Firm*—McHale & Slavin

(57) ABSTRACT

A non-reusable locking device for sealing containers. The locking device employs an insertion bolt which is insertable into a receptacle having locking flanges to prevent removal of the insertion bolt once inserted into the receptacle. A rigid housing surrounds and protects the receptacle, preventing access to the insertion bolt once inserted into the receptacle. A multi-part locking collar secures one end of a flexible cable permanently and rotatably within the housing. The second end of the cable is crimp-secured into a bore at one end of the insertion bolt. The flexible cable permits attachment to any type of container. The device forms a contiguous loop which can not be severed without destruction of the device. Once the loop is severed, it cannot be rejoined and provides instant indication that the container has been tampered with.

13 Claims, 3 Drawing Sheets

DISPOSABLE LOCK AND SEAL DEVICE

FIELD OF THE INVENTION

This invention relates to locking devices that provide indication of a seal, and more particularly to disposable, high-security, tamper-indicating locking devices.

BACKGROUND OF THE INVENTION

Trucks and trains are often used to transport goods over long distances. When transported this way, goods are often placed in freight storage containers. Because of the nature of the trip, which may take many days to complete, shipments of goods are often left unattended at some time before reaching their final destination. To protect the goods from theft, the storage container may be locked shut.

At one time, padlocks and combination locks were sufficient to lock storage containers. However, as truck and rail shipping grew in popularity, logistics and security-related issues rendered those types of locks insufficient, if not inappropriate. As shipping routes became more complex, goods were transported to remote destinations, with partial deliveries and pickups made along the way. As a result, more people handled a container before it reached its final destination. Padlocks and combination locks were logistical nightmares: because the locks were too expensive to merely destroy at each stop, each person who needed to access the container also needed access to the key or combination. Besides creating logistical concerns, these locks created accountability problems, as well: a padlock or combination lock could be completely cut off and replaced without any indication of the replacement. This meant that goods could be stolen without a shipper's knowledge. A container that had been robbed and re-secured might leave the scene of the crime before the goods or thief could be found. And because many shippers might handle a container before it reached its destination, blame for lost goods was difficult to assess. These logistical and accountability-based problems prompted use of alternate sealing devices.

Seals were designed to avoid the logistical and accountability problems. Often these designs used brittle materials which cracked or shattered when an attempt was made to defeat the seal. Other types of seals were constructed with alternating layers of high-contrast materials which gave visual indication that the surface of the seal had been abused. Alas, these seals provided a barrier that was more psychological than physical. In other words, these were highly visible and often deterred "conscientious" thieves. Unfortunately, these "tamper-indicating" seals would not protect goods from theft by determined criminals. These seals were not sufficient.

Accordingly, new, more-rugged seals were created. However, while these new seals provided improved security, they were troublesome in their own right. As seals were created with more structural integrity, their application often required the use of tools. For example, U.S. Pat. No. 3,862,775 discloses a seal which has a portion that must be permanently deformed by the user. These seals were too hard to use.

Other seals were designed to provide security without the use of tools. To accomplish this, many seals comprised various dedicated parts which the user combined to create a container seal. For example, U.S. Pat. No. 4,592,579 discloses a seal having a barrel that slides onto a segmented insert that has passed through hasps on a pair of container doors. This type of seal often eliminated the need for tools, but created a new problem: if one component was missing, the others were essentially useless. In order to use large numbers of these multi-component seals efficiently, careful inventory of the individual parts had to be kept. If a user ran short of one component, the seal could not be applied correctly. Ultimately, these seals created the logistical problems that existed with padlocks and combination locks.

Accordingly, what is needed is a locking device for sealing containers that is inexpensive, disposable, applied without tools, and designed to indicate unauthorized entry into a container.

SUMMARY OF THE INVENTION

The present invention is a non-reusable locking device for sealing containers, such as trucks and train-shipping containers. The device employs an insertion bolt constructed from steel which is attached to the first end of a flexible steel cable. A multi-part cable collar is permanently attached to the second end of the cable and placed into one end of a hardened-steel cylindrical housing. A process of crimping the housing permanently secures the collar within the housing and secures a receptacle inside the opposite end of the housing. Locking flanges on the receptacle allow one-way insertion of the insertion bolt wherein a biasing ring that encircles the flanges permanently locks the bolt into a non-retractable position. With the bolt locked in the receptacle, the device forms a contiguous loop which may not be opened without cutting the cable. The housing may also contain is indicia to allow tracking of the device or to indicate authenticity.

The locking device may be used to secure a container by threading the insertion bolt and attached flexible cable through a wide variety of hasps or brackets secured to the doors of the container. After the insertion bolt passes through the hasps, it is inserted into the receptacle until the head of the bolt engages the locking flanges. This engagement prevents removal of the bolt and creates a contiguous metal loop. Because access to the bolt and locking flanges is prevented by the housing, containers secured by this device may not be opened unless the device is cut off. Once the device has been cut off, it is destroyed and may not be used again. Because each device is imprinted with unique indicia, the integrity of a once-secured container may be verified by comparing the serial number of the locking device currently on the container with an earlier-recorded serial number.

Accordingly, it is an object of the present invention to provide a non-reusable locking device for sealing containers which deters theft and provides visual indication of any unauthorized entry into a container.

Yet another object of the present invention is to provide a non-reusable locking device for sealing containers which is imprinted with a serial number that allows tracking and/or authenticity verification.

A further object of the present invention is to provide a non-reusable locking device for sealing containers that requires no tools for installation.

Still another object of the present invention is to provide a non-reusable locking device for sealing containers which is self-contained and distributed as an all-inclusive unit.

A still further object of the present invention is to provide a non-reusable locking device for sealing containers that may be used to seal a wide variety of container doors, which may or may not include designated hasps for a locking seal.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
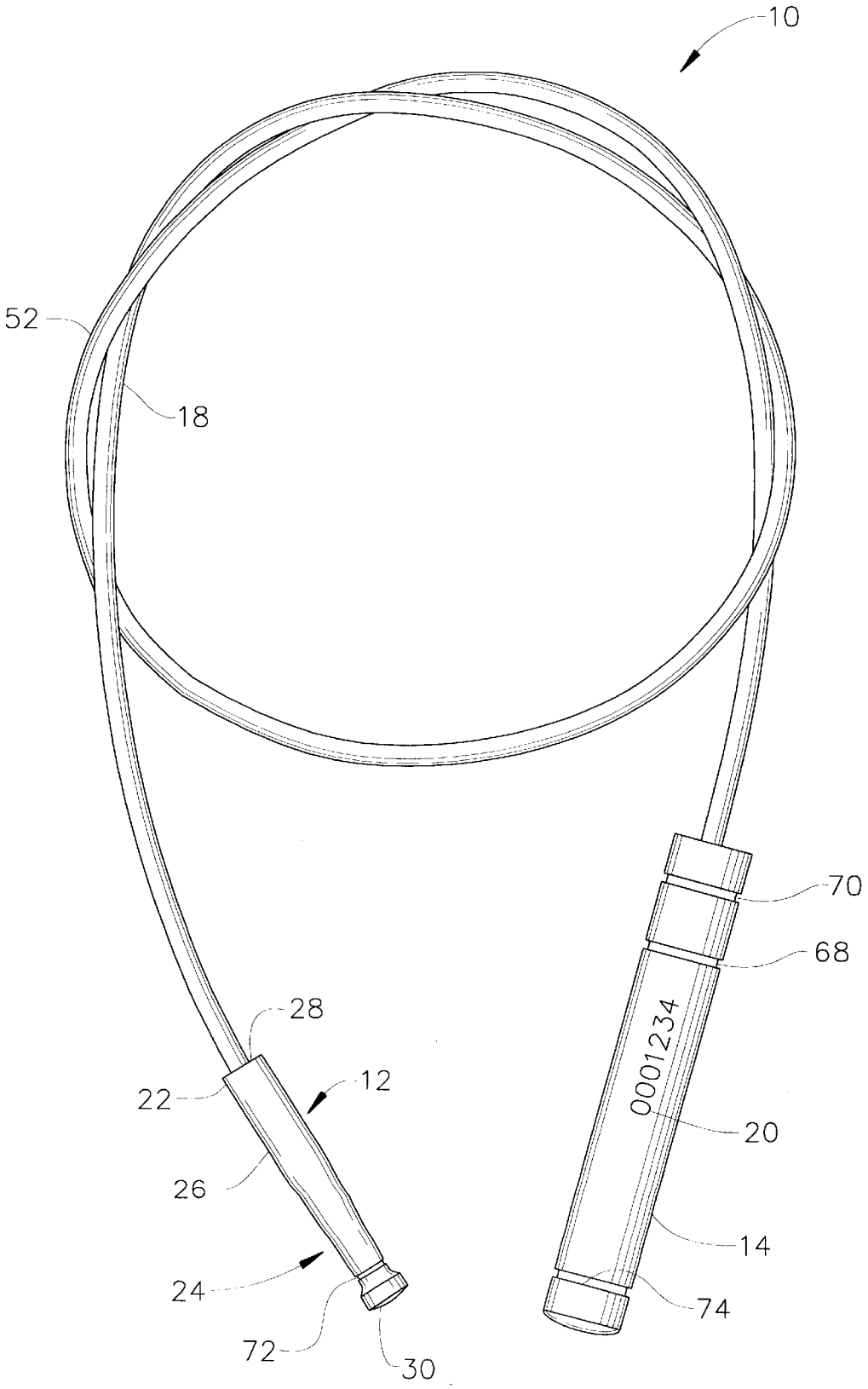
FIG. 1 is an overhead view showing the present invention in an unlocked position.
Figure 2C:
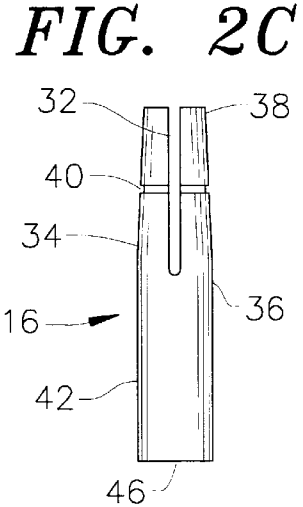
FIG. 2C is an overhead view of an elongated receptacle included in the present invention.
Figure 2D:
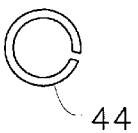
FIG. 2D is an overhead view of a biasing ring that passes around the receptacle shown in FIG. 2C.
Figure 2B:
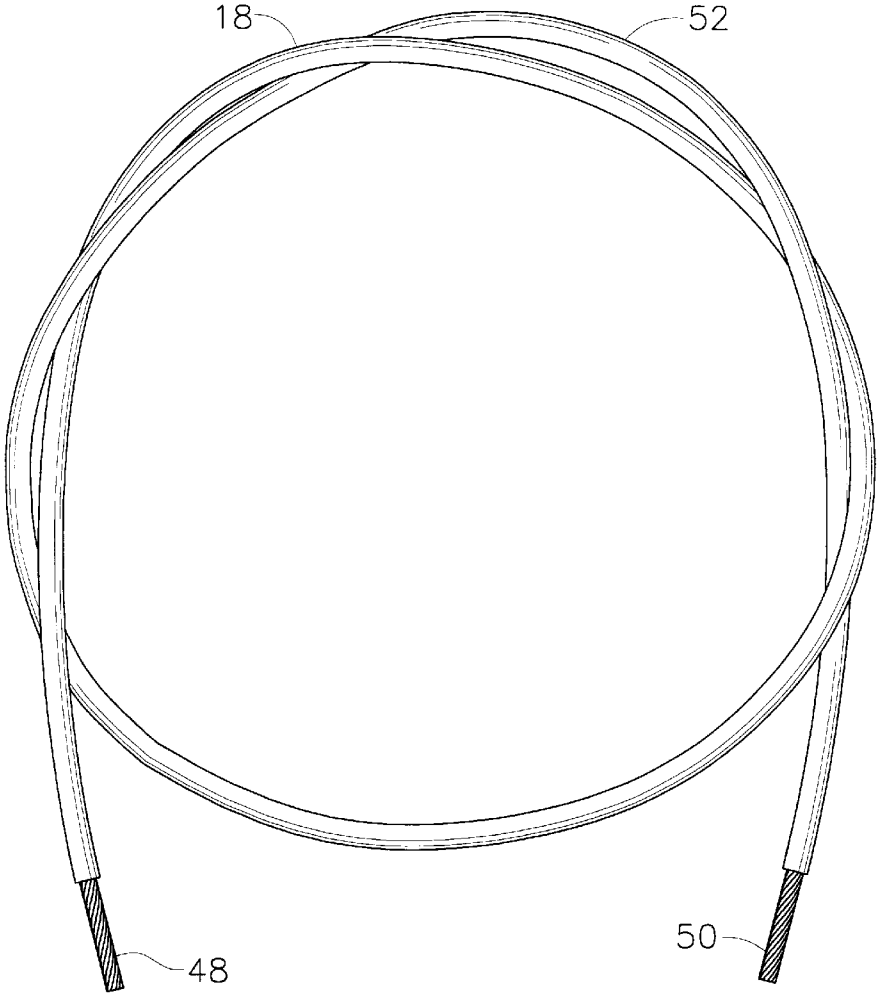
FIG. 2B is an overhead view of a cable found in the present invention.
Figure 2A:
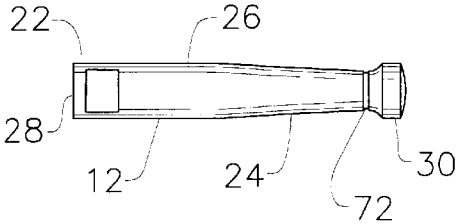
FIG. 2A is an overhead view of an insertion bolt of the present invention.
Figure 2E:
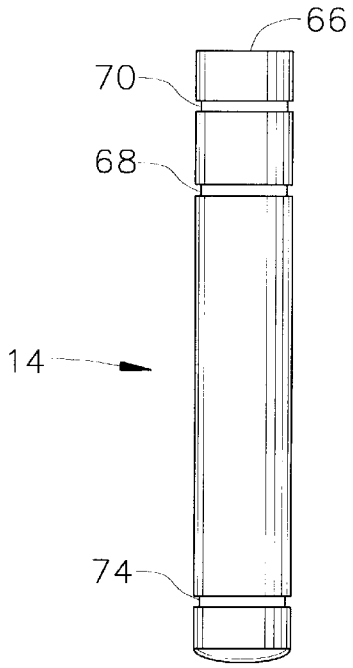
FIG. 2E is an overhead view of a housing found in the present invention.
Figure 2F:
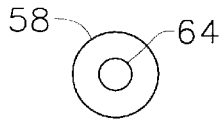
FIG. 2F is an overhead view of a first cable-securing disc.
Figure 2G:
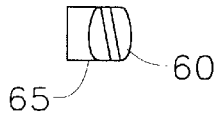
FIG. 2G is an overhead view of a disc spacer.
Figure 2H:
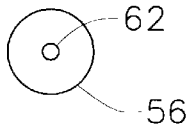
FIG. 2H is an overhead view of a second cable-securing disc.

Although the invention is described in terms of a specific embodiment, it will be readily apparent to those skilled in this art that various modifications, rearrangements and substitutions can be made without departing from the spirit of the invention. The scope of the invention is defined by the claims appended hereto. Reference is now made to FIG. 1, wherein a non-reusable locking device 10 for storage containers is shown. The device 10 comprises an insertion bolt 12, a substantially-cylindrical housing 14, having an elongated receptacle placed therein, a coated flexible steel cable 18, and an identifying mark 20 permanently fixed on the outside of the housing.

The insertion bolt 12 is an elongated, substantially-cylindrical piece of steel having a cable-crimp end 22. The opposite end of the insertion bolt 12 forms an insertion end 24, wherein the insertion end and the cable-crimp end 22 are spaced apart by a smooth, tapered shoulder 26. The insertion bolt 12 is approximately two inches long. The diameter of the shoulder 26 decreases from a maximum of approximately five-eights of an inch at the cable-crimp end 22 to a minimum diameter at the insertion end 24. The cable-crimp end 22 has a centrally-disposed bore 28 which is coaxial with the major axis of the insertion bolt 12. The terminus of the insertion end 24 flares into an enlarged head portion 30. The head portion 30 has a diameter of approximately three-eights of an inch.

In the preferred embodiment, the housing 14 is a single-piece, elongated tube. The housing 14 is made of a chrome alloy which resists oxidation. The cylindrical receptacle 16 is welded inside the housing 14. The receptacle 16 is essentially a slotted, hollow steel tube.

Referring now to FIGS. 2A through 2H collectively, four elongated slots 32 perforate the wall of the receptacle 16. The slots 32 run longitudinally, parallel to the major axis of the receptacle 16. The four elongated slots 32 create four corresponding locking flanges 34 which extend longitudinally from a middle section 36 of the receptacle 16. The locking flanges 40 resemble cantilevered planks which are spaced apart by the slots 32, and terminate in free ends 38.

A groove 40 is formed into the outer surface 42 of the receptacle 16. The groove 40 is substantially perpendicular to the major axis of the receptacle 16 and provides a preferred location for a biasing ring 44. The biasing ring 44 is essentially a split metallic ring. At equilibrium, the inner diameter of the biasing ring 44 is smaller than the outer diameter of the receptacle 16. The biasing ring 44 tends to force the flange free ends 38 into contact with one another. While one end of the receptacle 16 is characterized by the flange free ends 38, the opposite end of the receptacle is defined by a receptacle entry aperture 46.

The flexible steel cable 18 extends between the insertion bolt 12 and the housing 14. The cable 18 is characterized by a proximal end 48 and a distal end 50. Between these ends 48, 50 the cable 18 is coated by a plastic cover 52 to inhibit corrosion and damage to containers. The proximal end 48 is crimped permanently into the centrally disposed bore 28 located within the cable crimp end 22 of the insertion bolt 12. The distal end 50 is permanently and rotatably secured inside the housing 14. The distal end 50 of the cable 18 is held via interaction between a first cable-securing disc 56 and a second cable-securing disc 58, which are spaced apart by a hollow disc spacer 60. The first and second cable-securing discs 56, 58 are flat, metal plates; each has an outside diameter which is equal to the inside diameter of the housing 14. The first cable-securing disc 56 has a first-disc aperture 62 sized to accept the non-coated distal end 50 of the flexible cable 18. The second cable-securing disc 58 has a second-disc aperture 64 sized to accept the coated portion of the flexible cable 18. The disc spacer 60 is sandwiched between the first and second securing discs 56, 58 and has a hollow core 65 sized to accept a non-coated distal end 50 of the cable 18. In the preferred embodiment, the housing 14 has an outside diameter of approximately five-eights of an inch, while the housing length is approximately three-and-five-eights inches.

A locking collar which includes the first and second cable-securing discs 56, 58 and the disc spacer 60, positioned inside the housing with the first cable-securing disc 56 facing the flange free ends 38 and the second cable-securing disc 58 facing a collar-securing end 66 of the housing 14. A first disc-securing crimp 68 and disc-securing crimp 70 are pressed into the housing 14.

Each disc-securing crimp 68, 70 occupies a plane which is substantially orthogonal to the central access of the housing 14. The crimps 68, 70 are located so as to prevent motion of the first and second cable-securing discs 56, 58. This arrangement prevents lateral motion of the disc spacer 60, while still allowing the disc spacer to rotate within the housing, about the housing's central axis. The distal end 50 of the cable 18 is permanently secured within the core 65 of the disc spacer 60. This prevents removal of the cable distal end 50 from the housing 14, yet allows the cable 18 to freely rotate within the housing. This free rotation advantageously reduces the buildup of cable-damaging sheer forces after the device has been locked into place.

In use, the insertion end 24 of the insertion bolt 12 is fed into the entry aperture 46 of the receptacle 16, towards the receptacle's middle portion 36. The bolt 12 is fed into the receptacle 16 until the head 30 of the bolt 12 passes through the locking flanges 34 and emerges past the flange free ends 38. As the head 30 passes through the flanges 34, toward the flange free ends 38, the biasing ring 44 begins to dilate. As the head 30 nears the free ends 38, the ring's 44 diameter continues to increase temporarily. Once the head 30 clears the free ends 38, the biasing ring 44 snaps back into its original size. This compresses the flange free ends 38 into a bolt recess 72. The bolt recess 72 is a lateral groove which encircles the insertion bolt 12 at the location where the insertion end 24 joins the enlarged head portion 30. The biasing ring 44 forces the flange free ends 38 into the bolt recess 72. A large head portion 30 is sized to prevent removal of the insertion bolt after the head of the bolt has been pushed past the flange free ends. The bolt is, at that point, locked within the receptacle 16 which is welded inside the housing 14 and secured by receptacle crimp 74. The bolt 12, however, may rotate while locked within the receptacle 16.

A unique serial number 20 may be engraved into the housing 14. This serial number 20, which is different for each lock 10 produced, will render obvious the substitution of one lock for another.

Figure 3:
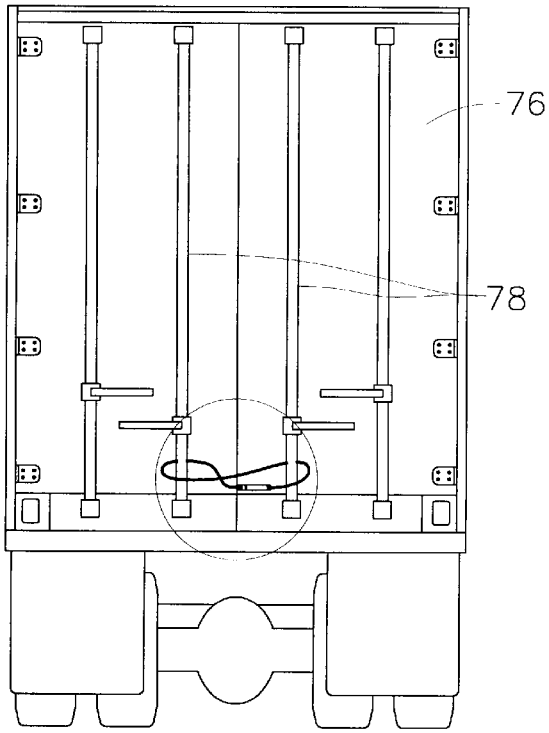
FIG. 3 is a pictorial view of the invention securing the container portion of a semi-tractor trailer truck.
Figure 3A:
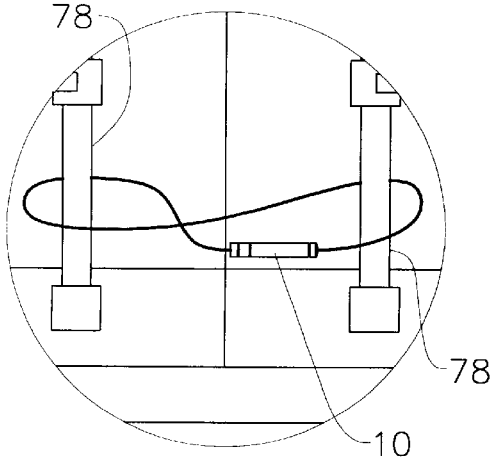
FIG. 3A is an enlarged view of a portion of pictorial view shown in FIG. 3.

Referring to FIGS. 3 and 3A, the device 10 is shown securing the container portion 76 of a truck. To secure the container, the insertion bolt 12 passes through securing hasps or rods 78. The cable 18 is threaded through the securing rods 78 and the insertion bolt 12 is pushed into the housing 14, until the enlarged head 30 passes through the locking flanges 34 and emerges past the flange free ends 38. Once the head 30 passes the flange free ends 38, the insert. The container 76 is secured by a contiguous loop of metal. The device 10 must be destroyed before it can be removed.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A non-reusable locking device for sealing containers, said device comprising:

an insertion bolt having a cable-crimp end spaced apart from an insertion end by a tapered shoulder, said insertion end abutting a head portion having a first diameter;

a housing with a receptacle positioned within said housing, said receptacle having a continuous sidewall and means for locking said insertion bolt within said receptacle; said locking means being defined as at least one slot extending longitudinally along a portion of said receptacle, said receptacle including a groove, said groove oriented substantially perpendicular to said at least on slot and sized for placement of a biasing ring which encircles said receptacle and forms a locking flange operatively associated with said insertion bolt, allowing uni-directional insertion of said insertion bolt into said receptacle;

a flexible cable having a proximal end attached via an attachment means to said insertion bolt and a distal end rotatably secured to said housing by a securing means including a first disc securing crimp disposed within said housing spaced apart from a second disc securing crimp disposed within said housing, said disc securing crimps defining a holder region within said housing; a cable securing spacer attached to a distal end of said cable, said spacer being disposed within said holder region, said spacer having a first end and an opposite second end; a first securing disc permanently disposed between said spacer first end and said first disc securing crimp, said first securing disc including a cable aperture constructed and arranged to accommodate said cable; a second securing disc disposed between said spacer second end and said second disc securing crimp, said second securing disc including a cable aperture constructed and arranged to accommodate said cable;

wherein placement of said insertion bolt into said receptacle forms a contiguous loop which cannot be severed without cutting tools, forming a visual seal and whereby said spacer is sandwiched between said securing discs, said securing discs being maintained within said holder region by said crimps, thereby maintaining said end of said cable within said holder region.

2. The non-reusable locking device for sealing containers according to claim 1, wherein said attachment means includes a centrally-located bore extending along a length of said cable-crimp end of said insertion bolt, said cable-crimp end being crimped after said proximal end of said cable is inserted therein.

3. The non-reusable locking device for sealing containers according to claim 1, wherein said insertion bolt, said receptacle, and said cable are made of steel.

4. The non-reusable locking device for sealing containers according to claim 1, including indicia placed on an outer sidewall of said housing.

5. The non-reusable locking device for sealing containers according to claim 4, wherein said indicia is a numerical code.

6. A non-reusable locking device for sealing containers, said device comprising:

an insertion bolt constructed from a single piece of elongated hardened steel having a cable-crimp end with a first diameter spaced apart from an insertion end by a smooth, tapered shoulder which decreases from said cable-crimp end to said insertion end, said cable-crimp end having a centrally-disposed bore extending along a length thereof and said insertion end having an enlarged head positioned at said insertion end;

a housing constructed from a single piece of elongated metal having an aperture placed therethrough;

a receptacle permanently positioned within said housing and sized to allow one-way insertion of said insertion bolt, said receptacle constructed from steel having a continuous sidewall with at least one elongated slot extending longitudinally along a portion of said receptacle, said sidewall including a groove placed perpendicular to said at least one slot and sized for placement of a biasing ring that encircles said receptacle and forms a locking flange operatively associated with said insertion bolt allowing said one-way insertion;

a flexible steel cable having a proximal end permanently secured to said insertion bolt and a distal end permanently and rotatably-secured to said housing; and indicia placed on an outer sidewall of said housing;

wherein said insertion of said insertion bolt into said receptacle forms a contiguous metal loop that cannot be broken without a cable cutter or cutting torch, said locking device providing a seal when used to close a container by placement of said device through locking hasps on said container.

7. The non-reusable locking device according to claim 6 including a recess located between said insertion end and said enlarged head, said recess operatively associated with the ends of said locking flange to prevent outward movement of said locking flange.

8. The non-reusable locking device according to claim 6 wherein said centrally-disposed bore is sized for insertion of said proximal end of said cable wherein a portion of said bore is crimped for permanent securement to said cable.

9. The non-reusable locking device according to claim 6 wherein said cable is coated with a plastic material.

10. The non-reusable locking device according to claim 6 wherein said distal end of said cable is secured to said housing by a locking collar, said locking collar defined by a first and second securing disc separated by a disc spacer, said locking collar being slidably insertable into said housing to abut a disc securing crimp disposed within said housing, whereby said locking collar is permanently secured within said housing by said disc securing crimp.

11. The non-reusable locking device according to claim 6 wherein said receptacle is crimped to securely fasten said receptacle to said housing.

12. The non-reusable locking device according to claim 6 wherein said receptacle is welded to permanently fasten said receptacle to said housing.

13. The non-reusable locking device according to claim 6 wherein said indicia is a numerical code, whereby said locking device may be tracked.

* * * * *